US012364932B1

(12) United States Patent
Liao

(10) Patent No.: US 12,364,932 B1
(45) Date of Patent: Jul. 22, 2025

(54) LUMINOUS FLYING DISC

(71) Applicant: Shulan Liao, Yongzhou (CN)

(72) Inventor: Shulan Liao, Yongzhou (CN)

( * ) Notice: Subject to any disclaimer, the term of this patent is extended or adjusted under 35 U.S.C. 154(b) by 0 days.

(21) Appl. No.: 18/964,748

(22) Filed: Dec. 2, 2024

(51) Int. Cl.
*A63H 33/18* (2006.01)
*A63B 65/10* (2006.01)

(52) U.S. Cl.
CPC ..... *A63H 33/18* (2013.01); *A63B 65/10* (2013.01); *A63B 2225/74* (2020.08)

(58) Field of Classification Search
CPC ..... A63H 33/18
See application file for complete search history.

(56) References Cited

U.S. PATENT DOCUMENTS 3,786,346 A * 1/1974 Lorenzi ..... G01N 27/84 324/216
5,032,098 A * 7/1991 Balogh ..... A63H 33/18 473/588
5,319,531 A * 6/1994 Kutnyak ..... A63H 33/18 473/588
5,611,720 A * 3/1997 Vandermaas ..... A63B 65/10 446/485
6,783,421 B1 * 8/2004 Lopez ..... A63H 23/10 446/485
7,347,758 B2 * 3/2008 Moore ..... A63H 33/18 446/219
8,858,289 B2 * 10/2014 Forte ..... A63H 33/18 446/242
11,612,828 B2 * 3/2023 Kocking ..... A63H 33/18 446/46
12,161,948 B2 * 12/2024 Ho ..... A63H 5/00
2023/0037021 A1 * 2/2023 Hoang ..... A63H 33/18

FOREIGN PATENT DOCUMENTS

CN 1552492 A 12/2004
CN 218980432 U 5/2023
CN 219815219 U 10/2023

* cited by examiner

*Primary Examiner* — John A Ricci
(74) *Attorney, Agent, or Firm* — Nitin Kaushik

(57) ABSTRACT

The present invention relates to the technical field of frisbees and discloses a luminous frisbee, including a frisbee cover and a mainboard housing on a bottom portion of the frisbee cover. At least one light guide strip is configured on an inner side of the bottom portion of the frisbee cover, and light emitted by the light guide strip radiates toward an inner side of a center of the frisbee in a radial direction. A circuit control board is connected to a power supply assembly in a control manner and is sealed in a circuit chamber enclosed by the frisbee cover and the mainboard housing. The light emitted by the light guide strip radiates toward the inner side of the center of the frisbee in the radial direction.

18 Claims, 7 Drawing Sheets

LUMINOUS FLYING DISC

The present invention relates to the technical field of flying disc, and in particular, to a luminous flying disc.

BACKGROUND

In the existing entertainment and sporting goods market, a luminous flying disc is an aerodynamic object, which flies in the air and is generally used for a variety of purposes from professional sports use to entertainment use. As a product that combines fun and technology, the luminous flying disc has gradually been loved by vast consumers.

Generally, the flying disc is roughly circular. A distance and a path of the flying disc can be based on a wrist, an arm, a torso, or one or more similar attributes of a player. For example, the flying disc can be transferred through rotation according to an action of the wrist when the player throws the flying disc, and the flying disc can also be used in entertainment venues such as a park, a beach, and a backyard.

With the widespread popularity of flying disc, the flying disc can be used in various environments, for example, at night, in a low-light weather condition such as a cloudy or rainy day, or in a low-light venue such as indoors. Similarly, the flying disc can be used in another different environment, for example, in a water area near the beach. Therefore, a traditional flying disc may not be suitable for different applications, for example, entertainment and professional use, and may not be suitable for different environments, for example, different weather conditions such as darkness, a rainy day, and a forest. In addition, the traditional flying disc may not be dynamically adjusted in various environments.

To adapt to being used in different environments, a traditional luminous flying disc generally adopts a design method of directly disposing LED lamp beads on the surface of the flying disc. According to a luminous flying disc on the current market, to achieve better lighting effects, lamp beads of a light strip are generally disposed along an edge of the flying disc (or radially) toward an outer side of the f flying disc. In this way, the light emitted by the lamp beads directly penetrates through a transparent or translucent housing to be emitted outward. In a night-vision environment, the light directly illuminates human eyes, irritating or even damaging eyesight. In addition, an outer ring wrapped around the light strip is generally formed through one-shot injection molding and is made of the same material as that of the housing of the flying disc. The material is relatively hard and is easy to be damaged during landing or collision.

SUMMARY

A main purpose of the present invention is to provide a luminous flying disc, aiming to solve a technical problem that the luminous flying disc is prone to hurting human eyes when emitting light during working.

To implement the above purpose, the present invention is provided and includes a flying disc cover and a mainboard housing on a bottom portion of the flying disc cover, where at least one light guide strip is configured on an inner side of the bottom portion of the flying disc cover, and light emitted by the light guide strip radiates toward an inner side of a center of the flying disc in a radial direction; and a circuit control board is connected to a power supply assembly in a control manner and is sealed in a circuit chamber enclosed by the flying disc cover and the mainboard housing.

A preferred solution is that: the circuit chamber enclosed by the flying disc cover and the mainboard housing is located in the center of the flying disc.

A preferred solution is that: the light guide strip is connected to the inner side of the bottom portion of the flying disc cover in an injection molding manner.

A preferred solution is that: the flying disc cover is of a positive curvature shape.

A preferred solution is that: the light guide strip includes an LED lamp strip and an LED lamp bead arrayed on the LED lamp strip, an outer side of the LED lamp strip is integrally formed on an inner side of the flying disc cover, and the LED lamp bead is attached to an inner side of the LED lamp strip.

A preferred solution is that: the light guide strip further includes an annular light guide ring, the annular light guide ring and an edge of the flying disc cover are integrally formed, and the LED lamp strip attached with the LED lamp bead and an extended edge of the flying disc cover are wrapped in the annular light guide ring.

A preferred solution is that: the LED lamp strip is formed on an inner side wall of the flying disc cover in an injection molding manner, the annular light guide ring is connected to the flying disc cover in a two-shot injection molding manner, and the flying disc cover, the annular light guide ring, and the LED lamp strip form an integral waterproof barrier.

A preferred solution is that: the annular light guide ring is made of polypropylene (PP), low density polyethylene (LDPE), thermoplastic elastomer (TPE), polyurethane (PU), thermoplastic polyurethane (TPU), or high density polyethylene (HDPE).

A preferred solution is that: the LED lamp bead is connected to the circuit control board, to control output power of the LED lamp bead.

A preferred solution is that: the LED lamp bead is a multi-color light-emitting diode (LED).

A preferred solution is that: the LED lamp bead is connected to the circuit control board, to form a plurality of flash modes through control.

A preferred solution is that: the circuit control board is disposed in the circuit chamber, the circuit control board is connected to the power supply assembly, and an LED element emitting light toward the flying disc cover is disposed on a top surface of the circuit control board.

A preferred solution is that: the luminous flying disc further includes a charging cover, a bottom portion of the mainboard housing is provided with a charging hole, the charging cover covers the bottom portion of the mainboard housing, a protective plug of the charging cover is inserted into the charging hole and is directly opposite to a charging interface of the circuit control board, an engaging column penetrating through the mainboard housing is disposed on the charging cover, and a clamping circle located in the circuit chamber is disposed on a middle segment of the engaging column.

A preferred solution is that: an edge of the charging cover is provided with a shifting piece portion, the mainboard housing is provided with a mounting groove corresponding to the charging cover, the mainboard housing is provided with a matching notch corresponding to the shifting piece portion, the charging cover is embedded in the mounting groove, the shifting piece portion is attached to the matching notch, and the shifting piece portion extends out of the matching notch.

A preferred solution is that: the edge of the charging cover is provided with a protrusion portion, and the protrusion portion is embedded in the mounting groove.

A preferred solution is that: the luminous flying disc further includes a decorative piece covering a bottom portion of the mainboard housing, a protective elastic piece corresponding to a switch button of the circuit control board is disposed on the bottom portion of the mainboard housing, and the decorative piece is provided with a pressing bulge at a position corresponding to the protective elastic piece.

A preferred solution is that: a top portion of the mainboard housing is provided with a convex circle, the bottom portion of the flying disc cover is provided with an annular groove corresponding to the convex circle, and the convex circle is clamped in the annular groove.

A preferred solution is that: a sealing ring is disposed between the convex circle and the annular groove.

Advantages of the present invention are as follows:

1. The light emitted by the light guide strip radiates toward the center of the flying disc in the radial direction, and then the light is scattered to the outside softly and uniformly by using light transmission and light spreading characteristics of the annular light guide ring, avoiding direct and concentrated emission of the light from the edge, so that a possibility of hurting human eyes by the light is effectively reduced.

2. The light strip is connected to the inner side of the bottom portion of the flying disc cover in an injection molding manner, and the light guide strip is made of thermoplastic elastomer (TPE) and other soft materials, so that the light guide strip is not prone to damage during landing or collision, and a service life of the light guide strip is increased.

BRIEF DESCRIPTION OF THE DRAWINGS

The accompanying drawings corresponding to one or more embodiments are exemplarily illustrated, and these exemplary illustrations do not constitute limitations to the embodiments. Elements with the same reference numerals in the accompanying drawings represent similar elements, and unless otherwise stated, the figures in the accompanying drawings do not constitute a proportion limitation.

Figure 1:
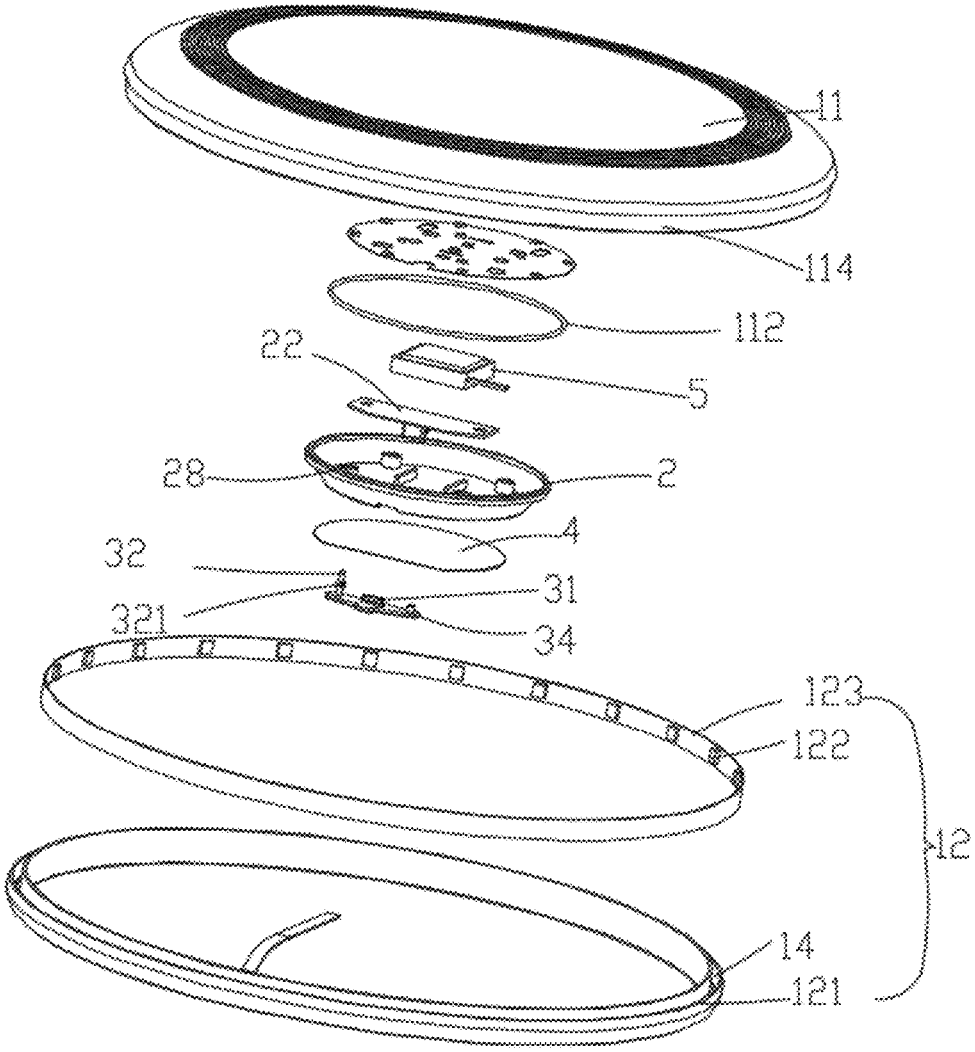
FIG. 1 is a first schematic structural exploded view of an embodiment of a luminous flying disc according to the present invention.
Figure 2:
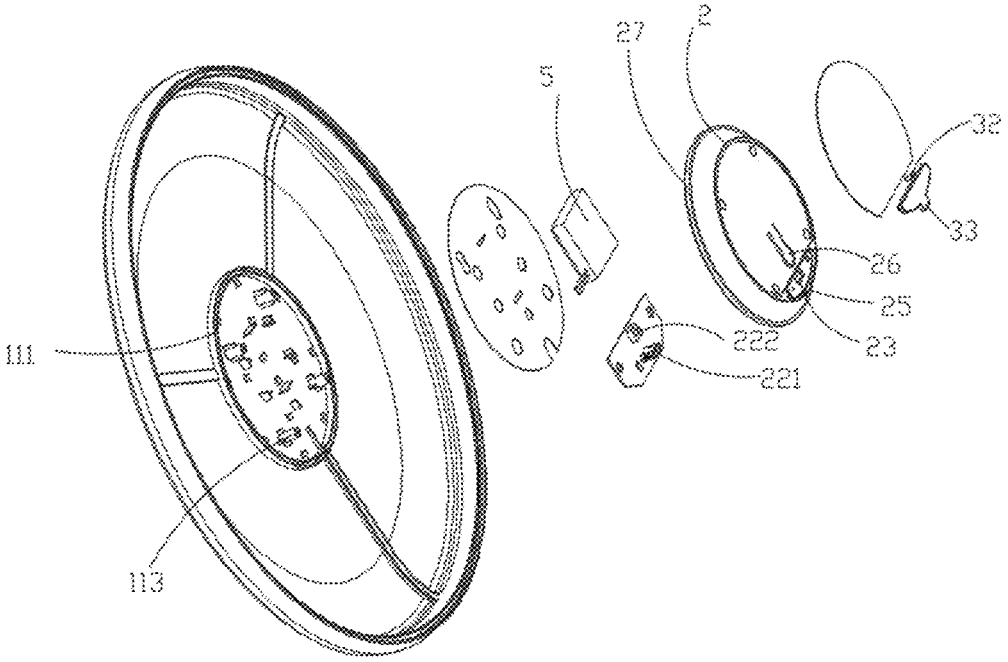
FIG. 2 is a second schematic structural exploded view of an embodiment of a luminous flying disc according to the present invention.
Figure 3:
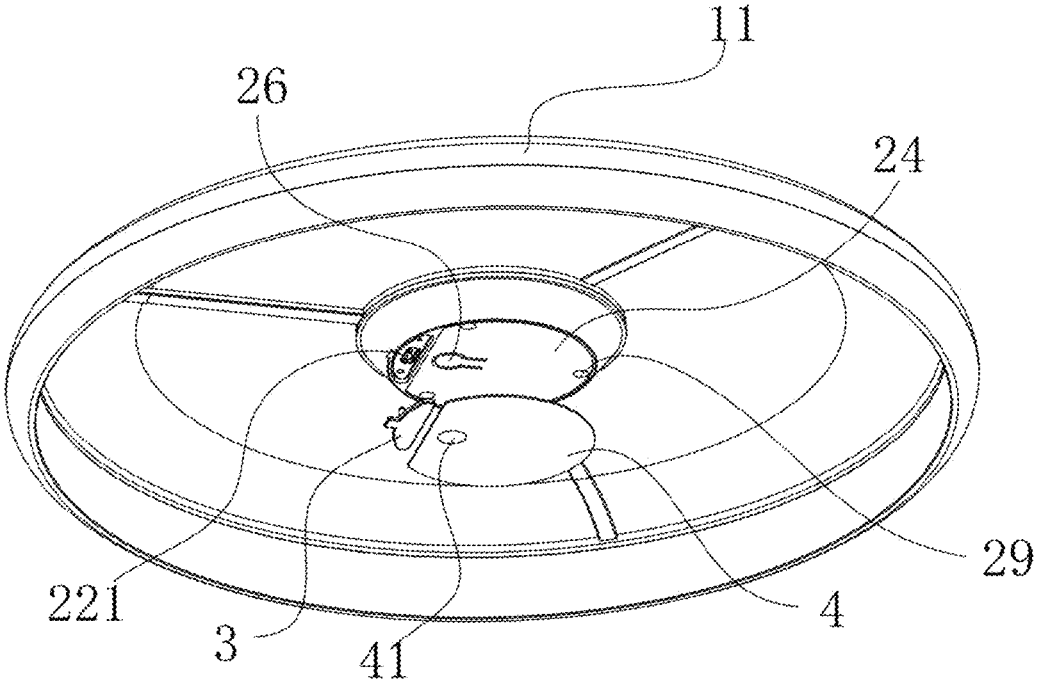
FIG. 3 is a third schematic structural exploded view of an embodiment of a luminous flying disc according to the present invention.
Figure 4:
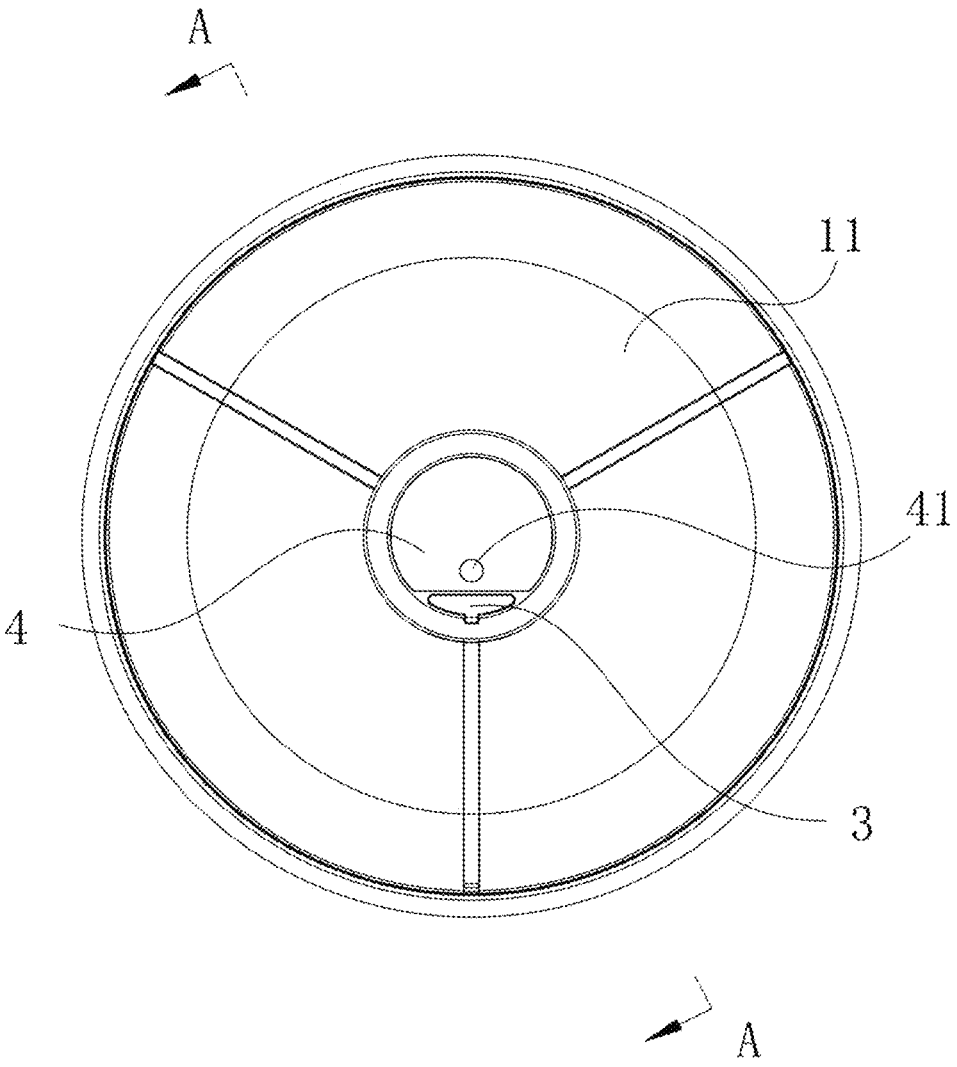
FIG. 4 is a schematic structural bottom view of an embodiment of a luminous flying disc according to the present invention.

Reference numerals in the drawings: 11. flying disc cover; 111. annular groove; 112. sealing ring; 114. terrace; 12. light guide strip; 121. annular light guide ring; 122. LED lamp bead; 123. LED lamp strip; 2. mainboard housing; 21. circuit chamber; 22. Circuit control board; 221. charging interface; 222. switch button; 23. charging hole; 24. mounting groove; 25. matching notch; 26. protective elastic piece; 27. convex circle; 28. first stud; 29. connecting threaded hole; 29. lamp panel; 291. LED element; 3. charging cover; 31. protective plug; 32. engaging column; 321, clamping circle; 33. shifting piece portion; 34. protrusion portion; 4. decorative piece; 41. pressing bulge; 5. power supply assembly.

DETAILED DESCRIPTION OF THE EMBODIMENTS

For ease of understanding of the present invention, the present invention is described in more detail with reference to the accompanying drawings and specific embodiments. It should be noted that, when an element is described to be "fixed to" another element, the element may be directly positioned on the another element, or there may be one or more centered elements between the element and the another element. When an element is described to be "connected to" another element, the element may be directly connected to the another element, or there may be one or more centered elements between the element and the another element. The terms "vertical", "horizontal", "left", "right", "inner", "outer", and similar expressions used in the specification are used for illustrative purposes only. In the descriptions of the present invention, the terms "first" and "second" are merely intended for description purposes, and shall not be understood as an indication or implication of relative importance or implicit indication of a quantity of indicated technical features. Therefore, unless otherwise specified, a feature limited by "first" or "second" may explicitly or implicitly include one or more features; and "a plurality of" means two or more. The term "include" and any variation thereof are intended to cover non-exclusive inclusions, and one or more other features, integers, steps, operations, units, assemblies, and/or combinations thereof may exist or may be added.

In addition, unless otherwise explicitly specified and limited, the terms "mount", "interconnect", and "connect" should be understood in a broad sense. For example, such terms may indicate a fixed connection, a detachable connection, or an integral connection; may indicate a mechanical connection or an electrical connection; and may indicate direct interconnection, indirect interconnection through an intermediate medium, or internal communication between two elements. All technical and scientific terms used in the specification have the same meaning as those commonly understood by a person skilled in the art of the present invention. The terms used in this specification of the present invention are merely for the purpose of describing specific embodiments but are not for limiting the present invention. The term "and/or" used in the specification includes any and all combinations of one or more of the relevant listed items.

Moreover, the technical features mentioned in different embodiments of the present invention, which are described below, can be combined with each other as long as they do not conflict with each other.

The present invention provides a luminous flying disc, including a flying disc cover 11, a light guide strip 12, and a mainboard housing 2. The light guide strip 12 covers an inner side of a bottom portion of the flying disc cover 11, and the flying disc cover 11 is of a positive curvature shape.

The light guide strip 12 includes an annular light guide ring 121, an LED lamp bead 122, and an LED lamp strip 123. The LED lamp bead 122 is arrayed on the LED lamp strip 123, an outer side of the LED lamp strip 123 is integrally formed on an inner side of the flying disc cover 11, the LED lamp bead 122 is attached to an inner side of the LED lamp strip 123, the annular light guide ring 121 and an edge of the flying disc cover 11 are integrally formed, and the LED lamp strip attached with the LED lamp bead 122 and an extended edge of the flying disc cover 11 are wrapped in the annular light guide ring 121.

To be matched with the annular light guide ring 121 to wrap the edge of the flying disc cover 11, the edge of the flying disc cover 11 is provided with a terrace 114, and a U-shaped groove 14 of the annular light guide ring 121 wraps the terrace 114. In this way, surfaces of the annular light guide ring 121 and the flying disc cover 11 are basically in a same plane, which is aesthetic, and an integrally-formed structure is more stable.

Figure 5:
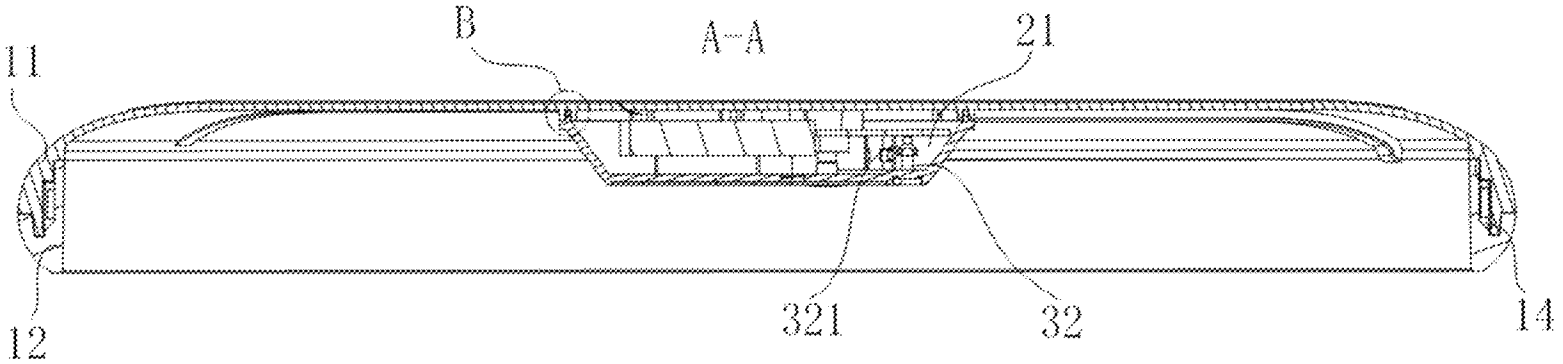
FIG. 5 is a sectional view along A-A in FIG. 4.
Figure 6:
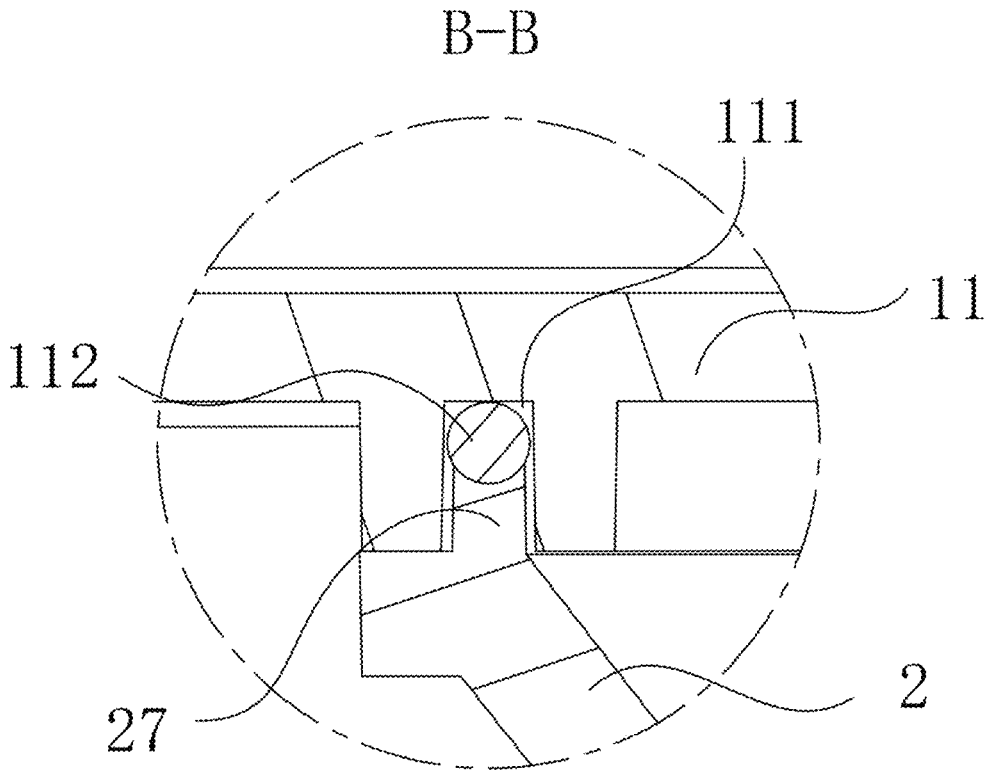
FIG. 6 is a partial enlarged view of a position B in FIG. 5.

The mainboard housing 2 is mounted on the bottom portion of the flying disc cover 11, and the mainboard housing 2 and the flying disc cover 11 are enclosed to form a circuit chamber 21 configured to mount a circuit control board 22 and a power supply assembly 5. As shown in FIG. 5: the circuit chamber 21 is located in the center of the flying disc, and the arrayed LED lamp bead 122 is electrically connected to the circuit control board 22.

As shown in FIG. 5: in the technical solution of the present invention, the LED lamp strip 123 is located in the U-shaped groove 14 of the annular light guide ring 121 of the flying disc, and when light emitted by the arrayed LED lamp bead 122 first illuminates the annular light guide ring 121, the annular light guide ring 121 scatters the light softly and uniformly by using light transmission and light spreading characteristics thereof, avoiding direct and concentrated emission of the light, so that a possibility of hurting human eyes by the light is effectively reduced.

The annular light guide ring 121 is made of a material of polypropylene (PP), low density polyethylene (LDPE), thermoplastic elastomer (TPE), polyurethane (PU), thermoplastic polyurethane (TPU), or high density polyethylene (HDPE).

Figure 7:
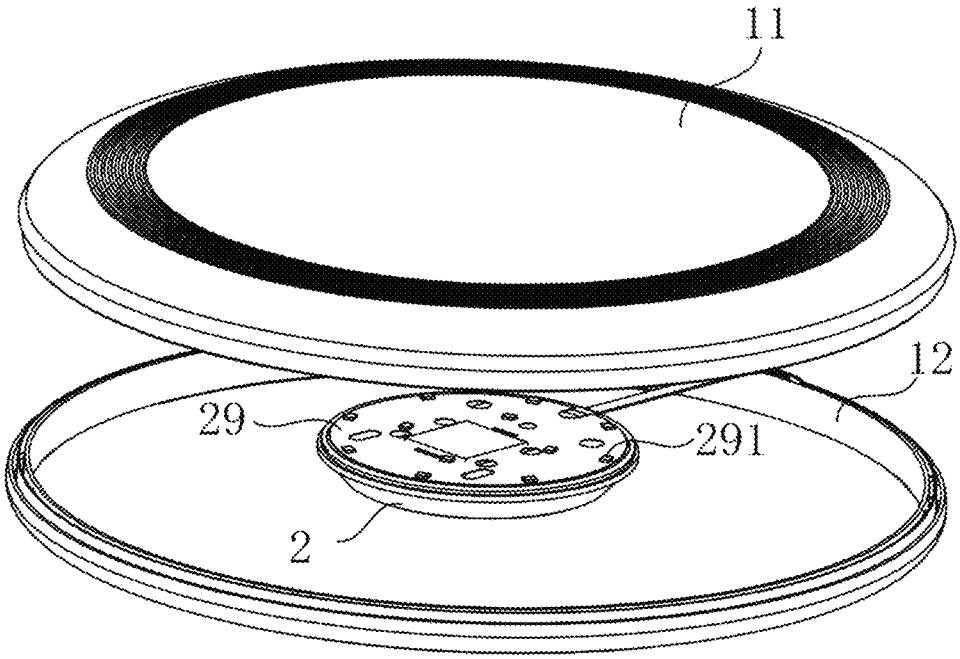
FIG. 7 is a fourth schematic structural exploded view of an embodiment of a luminous flying disc according to the present invention.

Referring to FIG. 1 and FIG. 7, in the embodiment, the inner side of the LED lamp strip 123 is attached, in an array manner, with a plurality of LED lamp beads 122 that are disposed at intervals. The LED lamp strip 123 is attached to the inner side of the flying disc cover 11, and the LED lamp beads 122 are oriented toward an inner side of the annular light guide ring 121. A circuit that supplies power to the LED lamp beads and performs signal control is integrated in the lamp strip and may control output power of the LED lamp bead 122, to form a plurality of flash modes. The plurality of LED lamp beads 122 disposed on the LED lamp strip 123 at intervals enables overall light emission to be more uniform and softer.

The LED lamp bead 122 may be a multi-color light-emitting diode (LED), which generates different colors of light and is more interesting.

Referring to FIG. 1 to FIG. 7, in the embodiment, the LED lamp strip 123 is formed on an inner side wall of the flying disc cover 11 in an injection molding manner, and the annular light guide ring 121 is connected to the flying disc cover 11 in a two-shot injection molding manner. The flying disc cover 11, the annular light guide ring 121, and the LED lamp strip 123 form an integral waterproof barrier through a one-shot injection process and a two-shot injection process, effectively preventing water from penetrating from the exterior into the interior of the flying disc.

Referring to FIG. 7, in the embodiment, a lamp panel 29 is disposed in the circuit chamber 21, an LED element 291 emitting light toward the flying disc cover 11 is disposed on a top surface of the lamp panel 29, and a part of the light is transmitted from the center of the flying disc. The design may increase fun and lighted appearance effects of the flying disc.

Referring to FIG. 1 to FIG. 6, in the embodiment, the luminous flying disc further includes a charging cover 3. A bottom portion of the mainboard housing 2 is provided with a charging hole 23, the charging cover 3 covers the bottom portion of the mainboard housing 2, a protective plug 31 of the charging cover 3 is inserted into the charging hole 23 and is directly opposite to a charging interface 221 of the circuit control board 22, an engaging column 32 penetrating through the mainboard housing 2 is disposed on the charging cover 3, and a clamping circle 321 located in the circuit chamber 21 is disposed on a middle segment of the engaging column 32. The charging cover 3 protects the charging interface 221 from external impurity and collision impacts by inserting the protective plug 31 into the charging hole 23, reducing a risk of interface damage caused by striking of external force. When charging is needed, the charging cover 3 is opened. Due to the clamping circle 321 on the engaging column 32, the charging cover 3 does not leave the mainboard housing 2, and the charging cover 3 is not thrown away during flight of the flying disc. The charging cover 3 is rotated with the engaging column 32 as an axis to 10 expose the charging hole 23, and an external charging cable passes through the charging hole 23 to be connected to the charging interface 221 in the circuit chamber 21 for charging. Matching between the clamping circle 321 and the mainboard housing 2 not only ensures stability of the charging cover 3 in a closed state, to prevent the charging cover from being opened accidentally during flight or carrying, but also enhances stability and durability of an entire structure.

Referring to FIG. 1 to FIG. 6, in the embodiment, an edge of the charging cover 3 is provided with a shifting piece portion 33, the mainboard housing 2 is provided with a mounting groove 24 corresponding to the charging cover 3, the mainboard housing 2 is provided with a matching notch 25 corresponding to the shifting piece portion 33, the charging cover 3 is embedded in the mounting groove 24, the shifting piece portion 33 is attached to the matching notch 25, and the shifting piece portion 33 extends out of the matching notch 25. The shifting piece portion 33 is disposed to enable a user to easily open or close the charging cover 3 by shifting the shifting piece portion 33 and also provides a fulcrum for rotating the charging cover 3, greatly facilitating an operation of the user.

Referring to FIG. 1 to FIG. 6, in the embodiment, the edge of the charging cover 3 is provided with a protrusion portion 34, and the protrusion portion 34 is embedded in the mounting groove 24. Tight matching between the protrusion portion 34 and the mounting groove 24 provides an additional fixed point for the charging cover 3, so that the charging cover 3 is fixedly on the mainboard housing 2 more stably in the closed state. This design effectively prevents the charging cover 3 from accidentally loosening or falling off during flight, carrying, or use due to external force, thereby ensuring stability and security of an overall structure of the flying disc.

Referring to FIG. 1 to FIG. 5, in the embodiment, the luminous flying disc further includes a decorative piece 4 covering the bottom portion of the mainboard housing 2, a protective elastic piece 26 corresponding to a switch button 222 of the circuit control board 22 is disposed on the bottom portion of the mainboard housing 2, and the decorative piece 4 is provided with a pressing bulge 41 at a position corresponding to the protective elastic piece 26. According to the design, pressure of pressing the switch by the user is transferred through the pressing bulge 41 and the protective elastic piece 26. Due to a gap around a protective spring, to isolate the circuit chamber 21 from the outside, the circuit chamber 21 is isolated from the outside through the decorative piece 4.

Referring FIG. 1 to FIG. 5, in the embodiment, a top portion of the mainboard housing 2 is provided with a convex circle 27, the bottom portion of the flying disc cover 11 is provided with an annular groove 111 corresponding to the convex circle 27, and the convex circle 27 is clamped in the annular groove 111. A clamping design between the convex circle 27 and the annular groove 111 simplifies assembly of the flying disc, greatly improving efficiency and convenience of assembly.

Referring to FIG. 1 and FIG. 5, in the embodiment, a sealing ring 112 is disposed between the convex circle 27 and the annular groove 111. The sealing ring 112 is added to effectively fill a micro gap between the convex circle 27 and the annular groove 111, to form a tighter sealing layer. This design can significantly prevent water, dust, and other impurities from penetrating into the circuit chamber 21 through the interface, thereby protecting the internal circuit control board 22 and electronic components from damage.

Referring to FIG. 1 to FIG. 5, in the embodiment, the top portion of the mainboard housing 2 is provided with a first stud 28, the flying disc cover 11 is provided with a second stud 113 penetrating through the circuit control board 22, the second stud 113 extends into the first stud 28, and the first stud 28 is connected to the second stud 113 through a screw.

Referring to FIG. 1 and FIG. 5, in the embodiment, the bottom portion of the mainboard housing 2 is provided with a connecting threaded hole 29 for threaded connection, and the decorative piece 4 covers the connecting threaded hole 29.

The above embodiments are only used to illustrate the technical solutions of the present invention rather than limiting thereto. In the idea of the present invention, technical features in the above embodiments or different embodiments may also be combined, steps may be implemented in any order, and many other variations of different aspects of the present invention as described above, which are not provided in detail for the sake of brevity, are available. Although the present invention has been described in detail with reference to the foregoing embodiments, those of ordinary skill in the art should understand that the technical solutions recited in the foregoing embodiments may still be modified, or some of the technical features thereof may be replaced with equivalents. These modifications or replacements do not make the essence of the corresponding technical solution deviate from the scope of the technical solutions in the embodiments of the present invention.

What is claimed is:

1. A luminous flying disc, comprising a flying disc cover, and a mainboard housing on a bottom portion of the flying disc cover, wherein at least one light guide strip is configured on an inner side of the bottom portion of the flying disc cover, and light emitted by the light guide strip radiates toward an inner side of a center of the flying disc in a radial direction; and a circuit control board is connected to a power supply assembly in a control manner and is sealed in a circuit chamber enclosed by the flying disc cover and the mainboard housing.

2. The luminous flying disc according to claim 1, wherein the circuit chamber enclosed by the flying disc cover and the mainboard housing is located in the center of the flying disc.

3. The luminous flying disc according to claim 1, wherein the light guide strip is connected to the inner side of the bottom portion of the flying disc cover in an injection molding manner.

4. The luminous flying disc according to claim 1, wherein the flying disc cover is of a positive curvature shape.

5. The luminous flying disc according to claim 1, wherein the light guide strip comprises an LED lamp strip and an LED lamp bead arrayed on the LED lamp strip, an outer side of the LED lamp strip is integrally formed on an inner side of the flying disc cover, and the LED lamp bead is attached to an inner side of the LED lamp strip.

6. The luminous flying disc according to claim 5, wherein the light guide strip further comprises an annular light guide ring, the annular light guide ring and an edge of the flying disc cover are integrally formed, and the LED lamp strip attached with the LED lamp bead and an extended edge of the flying disc cover are wrapped in the annular light guide ring.

7. The luminous flying disc according to claim 6, wherein the annular light guide ring is made of polypropylene (PP), low density polyethylene (LDPE), thermoplastic elastomer (TPE), polyurethane (PU), thermoplastic polyurethane (TPU), or high density polyethylene (HDPE).

8. The luminous flying disc according to claim 5, wherein the LED lamp strip is formed on an inner side wall of the flying disc cover in an injection molding manner, an annular light guide ring is connected to the flying disc cover in a two-shot injection molding manner, and the flying disc cover, the annular light guide ring, and the LED lamp strip form an integral waterproof barrier.

9. The luminous flying disc according to claim 5, wherein the LED lamp bead is connected to the circuit control board, to control output power of the LED lamp bead.

10. The luminous flying disc according to claim 5, wherein the LED lamp bead is a multi-color light-emitting diode (LED).

11. The luminous flying disc according to claim 5, wherein the LED lamp bead is connected to the circuit control board, to form a plurality of flash modes through control.

12. The luminous flying disc according to claim 1, wherein the circuit control board is disposed in the circuit chamber, the circuit control board is connected to the power supply assembly, and an LED element emitting light toward the flying disc cover is disposed on a top surface of the circuit control board.

13. The luminous flying disc according to claim 1, wherein the luminous flying disc further comprises a charging cover, a bottom portion of the mainboard housing is provided with a charging hole, the charging cover covers the bottom portion of the mainboard housing, a protective plug of the charging cover is inserted into the charging hole and is directly opposite to a charging interface of the circuit control board, an engaging column penetrating through the mainboard housing is disposed on the charging cover, and a clamping circle located in the circuit chamber is disposed on a middle segment of the engaging column.

14. The luminous flying disc according to claim 13, wherein an edge of the charging cover is provided with a shifting piece portion, the mainboard housing is provided with a mounting groove corresponding to the charging cover, the mainboard housing is provided with a matching notch corresponding to the shifting piece portion, the charging cover is embedded in the mounting groove, the shifting piece portion is attached to the matching notch, and the shifting piece portion extends out of the matching notch.

15. The luminous flying disc according to claim 14, wherein the edge of the charging cover is provided with a protrusion portion, and the protrusion portion is embedded in the mounting groove.

16. The luminous flying disc according to claim 1, wherein the luminous flying disc further comprises a decorative piece covering a bottom portion of the mainboard housing, a protective elastic piece corresponding to a switch button of the circuit control board is disposed on the bottom portion of the mainboard housing, and the decorative piece is provided with a pressing bulge at a position corresponding to the protective elastic piece.

17. The luminous flying disc according to claim 1, wherein a top portion of the mainboard housing is provided with a convex circle, the bottom portion of the flying disc cover is provided with an annular groove corresponding to the convex circle, and the convex circle is clamped in the annular groove.

18. The luminous flying disc according to claim 17, wherein a sealing ring is disposed between the convex circle and the annular groove.

* * * * *